US006796059B2

(12) United States Patent
Denisart et al.

(10) Patent No.: US 6,796,059 B2
(45) Date of Patent: Sep. 28, 2004

(54) IRONING BOARD AJDUSTABLE IN HEIGHT

(75) Inventors: Jean-Luc Denisart, Cully (CH); Antoine Cahen, Lausanne (CH); Jacques Schaeffer, Le Mont-Pélerin (CH)

(73) Assignee: LauraStar S.A., Chatel-St-Denis (CH)

( * ) Notice: Subject to any disclaimer, the term of this patent is extended or adjusted under 35 U.S.C. 154(b) by 0 days.

(21) Appl. No.: 10/451,916

(22) PCT Filed: Apr. 23, 2002

(86) PCT No.: PCT/CH02/00226

§ 371 (c)(1),
(2), (4) Date: Jun. 27, 2003

(87) PCT Pub. No.: WO02/090642

PCT Pub. Date: Nov. 14, 2002

(65) Prior Publication Data

US 2004/0049955 A1 Mar. 18, 2004

(30) Foreign Application Priority Data

May 9, 2001 (CH) ..... 839/01

(51) Int. Cl.[7] ..... D06F 81/04
(52) U.S. Cl. ..... 38/137
(58) Field of Search ..... 38/137, 138, 139, 38/DIG. 1, DIG. 2, DIG. 3; 108/47, 48, 229, 115, 116, 117, 152.12, FOR 102

(56) References Cited

U.S. PATENT DOCUMENTS 982,882 A * 1/1911 Schimmel ..... 280/43.16
2,526,666 A 10/1950 Johnson
2,578,826 A * 12/1951 Mrofka ..... 108/116
3,203,373 A * 8/1965 King ..... 108/138
3,288,090 A * 11/1966 King ..... 108/138
5,259,326 A * 11/1993 Borgman et al. ..... 108/147
5,669,314 A * 9/1997 Grant ..... 108/48

FOREIGN PATENT DOCUMENTS

| | | |
|---|---|---|
| DE | 1 077 402 | 3/1960 |
| EP | 0 646 671 | 4/1995 |
| FR | 1226602 | 7/1960 |
| FR | 1248806 | 3/1961 |
| FR | 2479294 | 10/1981 |
| GB | 2072711 | 10/1981 |

* cited by examiner

*Primary Examiner*—Ismael Izaguirre
(74) *Attorney, Agent, or Firm*—Nixon & Vanderhye, P.C.

(57) ABSTRACT

The invention concerns an ironing board (1) comprising: a working surface (2), a device for adjusting the height of the working surface (2), the support comprising at least two intersecting legs (3, 4) pivoting about a common hinge pin (5), the upper ends (7, 8) of the legs (3, 4) being secured to the working surface (2), at least one of the legs (4) being mobile, its upper end (7) adapted to be displaced in a plane parallel to that of the platform (2). The invention is characterised in that the height adjusting device comprises means for continuous adjustment consisting of a jack (6) made up of a first and a second part (11, 12), the first part of the jack (11) being secured to the mobile leg (4) and the common hinge pin (5).

9 Claims, 8 Drawing Sheets

IRONING BOARD AJDUSTABLE IN HEIGHT

This application is the U.S. national phase of international application PCT/CH02/00226 filed 23 Apr. 2002 which designated the U.S.

The present invention relates to an ironing board in which the height of the table can be adjusted.

It relates more specifically to an ironing board comprising two intersecting legs pivoting about a common axis.

French patent application FR-A-2 479 294 sets out an ironing board comprising two intersecting legs supporting a table, the under part of which is provided with a series of notches designed to take a free upper end of one of the two legs. Certain heights of the table can be selected by placing the free upper end of the leg in a corresponding notch.

European patent application EP-A-646 671 discloses a similar ironing board.

With ironing boards having intersecting legs as described above, changing the height is an operation requiring the use of both hands. Also, the choice of the ideal height is limited to a finite number of positions. More specifically, the number of heights available depends on the number of notches.

French patent FR 1 248 806 sets out a board having intersecting legs and provided in its under part with an adjustable tie bar consisting of a rotary screw inside a tube, the tie bar being so arranged as to connect the lower ends of the legs.

It is true that this device offers the possibility of adjusting the height to an almost limitless number of positions. However, besides the fact that the tie bar is bulky, it is also an obstruction for a user wishing to place either or both feet under the board while ironing.

Also, the arrangement of the tie bar limits the range of adjustment of the height of the board. More precisely, the maximum height of the board is a function of the length of the tie bar.

It is a particular object of the present invention to overcome the abovementioned drawbacks. It relates to an ironing board comprising:

a table a support for supporting the table and a device for adjusting the height of the table, the support comprising at least two intersecting legs pivoting about a common axis, the upper ends of the legs being made fast to the table, and at least one of the legs being moveable, its upper end being able to be moved in a plane parallel to that of the table, which board is characterized in that the device for adjusting the height comprises continuous height-adjusting means consisting of an jack composed of a first part and a second part, the first part of the jack being made fast to the moveable leg in the region defined between the upper end of the moveable leg and the common axis.

The term "continuous" should be understood as meaning "without intervals". The selection of available heights is therefore not limited to a finite number of positions.

The jack is preferably pneumatic. Its principle of operation can be likened to that of a pneumatic jack used to adjust the height of a chair.

It goes without saying that the continuous height-adjusting means used in the present invention, like a pneumatic jack, must allow not only an indefinite number of heights to be chosen, but also must allow the table to be locked at the corresponding heights.

By way of non-restrictive example of jacks that can be used for the present invention, mechanical or electrical jacks may be cited.

In one embodiment, the upper end of the second part of the jack is fixed to the support of the table.

In another embodiment, the upper end of the second part of the jack is fixed to the fixed leg. Furthermore, by fixing the first part of the jack into the upper part of the moveable leg, a locking mechanism is obtained which provides a certain closure of the board when the board is folded.

In another embodiment, the jack is part of and/or may coincide with the leg whose upper end can move freely in a plane parallel to that of the table.

The jack according to the invention can also act as an aid for opening the board.

To make the height-adjusting device more functional, the height-adjusting means are preferably controlled remotely.

In one particular embodiment of the invention, the height-adjusting means comprise a cable, of which the opposite end from the jack is accessible near the table, adjustment being effected by pulling the cable.

In one particularly advantageous embodiment, the end of the cable opposite from the jack is fixed to a rotary handle placed toward the table, the handle working on a principle similar to that of a motorcycle handle: rotating in one direction or the other pulls the cable and so actuates the jack.

Alternatively, the handle may be replaced by a lever which works in a similar way to a motor cycle brake.

Examples of embodiments of the invention are described below using the following figures.

Figure 1:
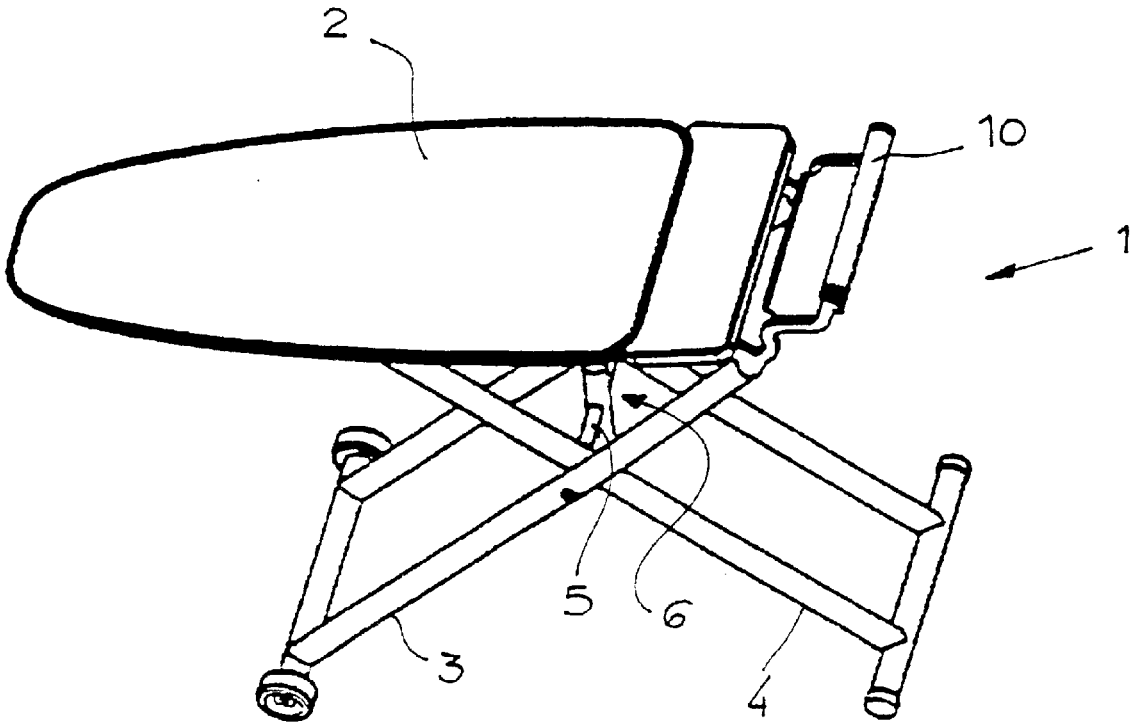
FIG. 1 shows a first embodiment of the invention

The ironing board (1) as seen in FIG. 1 consists of a table (2) supported by two intersecting legs (3, 4) pivoting about a common axis (5).

Figure 2:
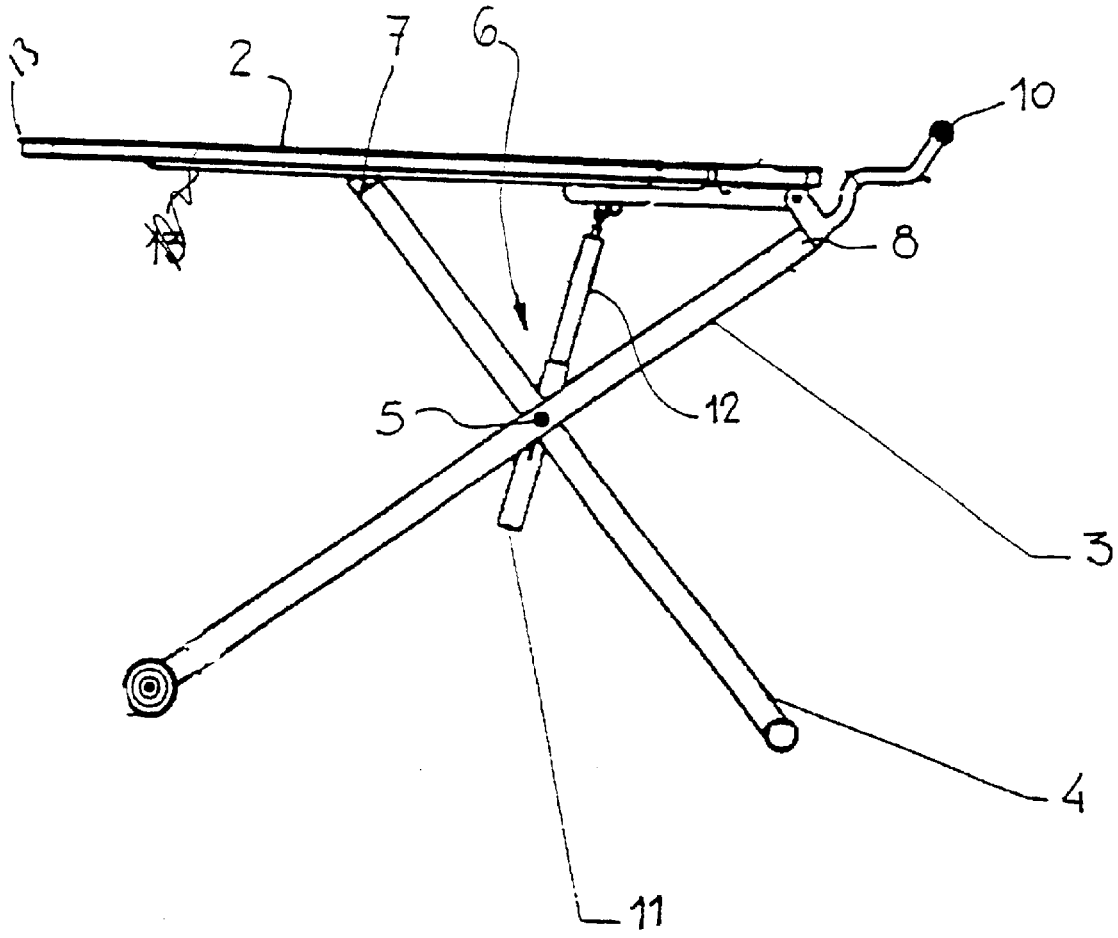
FIG. 2 shows the board shown in FIG. 1, seen from the side.

The upper end (7) of one of the two legs (4) (see FIG. 2) moves freely in a rail (13), in a direction parallel to the plane of the table (2). The upper end (8) of the other leg (3) is hinged toward the rear of the table (2).

Figure 3:
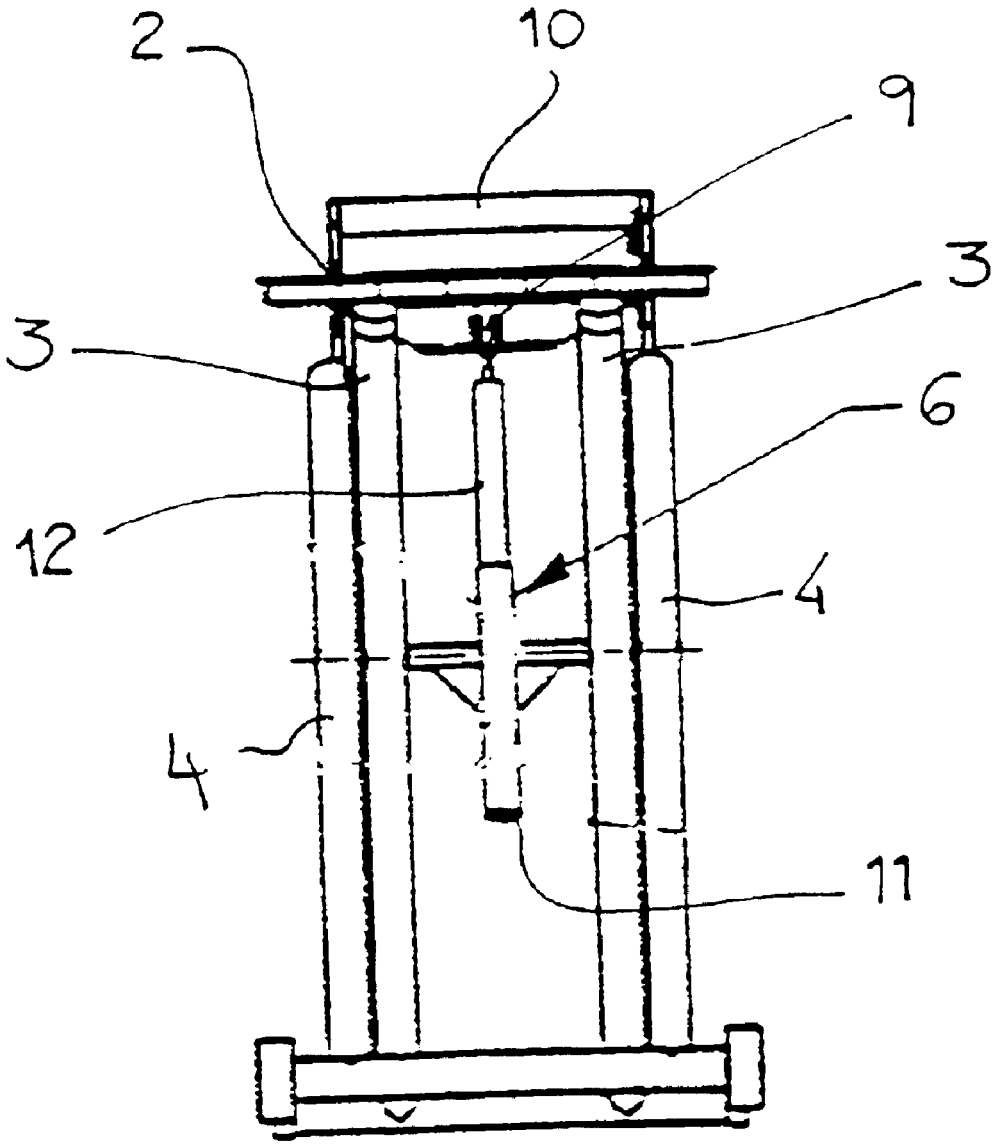
FIG. 3 shows the board shown in FIG. 1, seen from the front.
Figure 4:
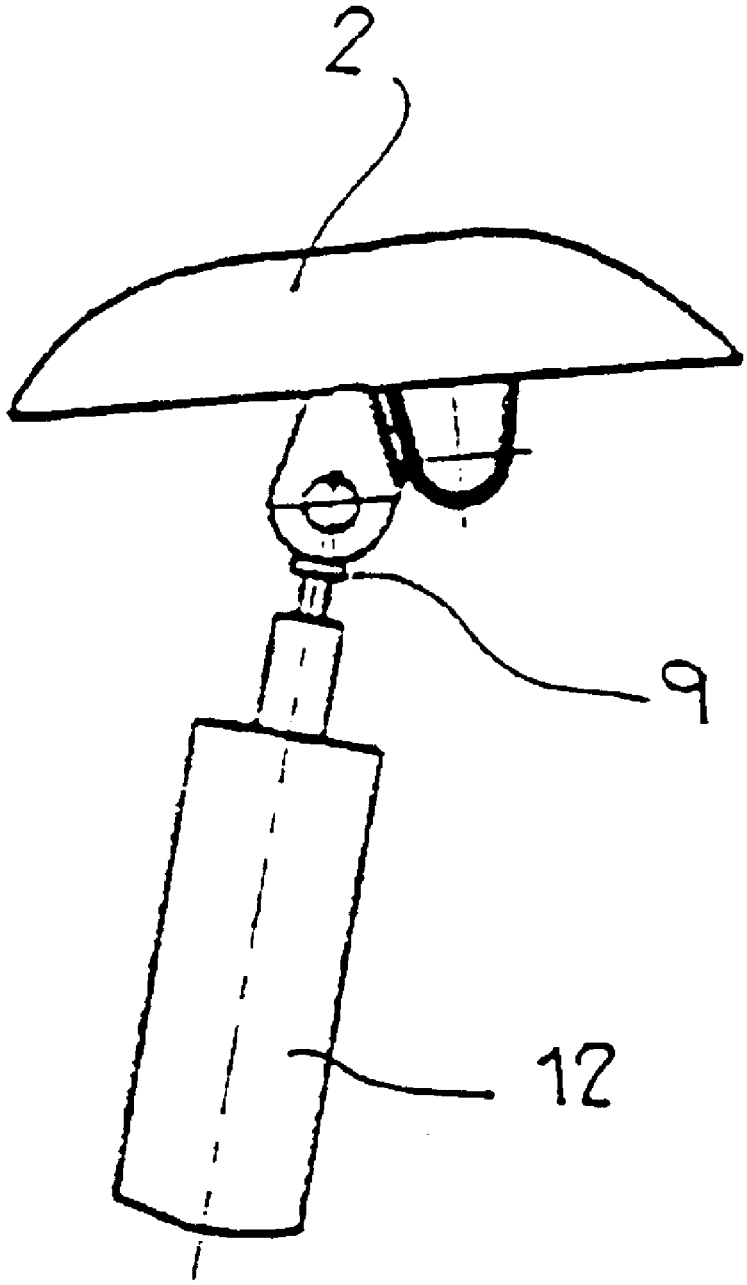
FIG. 4 shows an enlargement of the region where the upper part of an jack is fixed.
Figure 5:
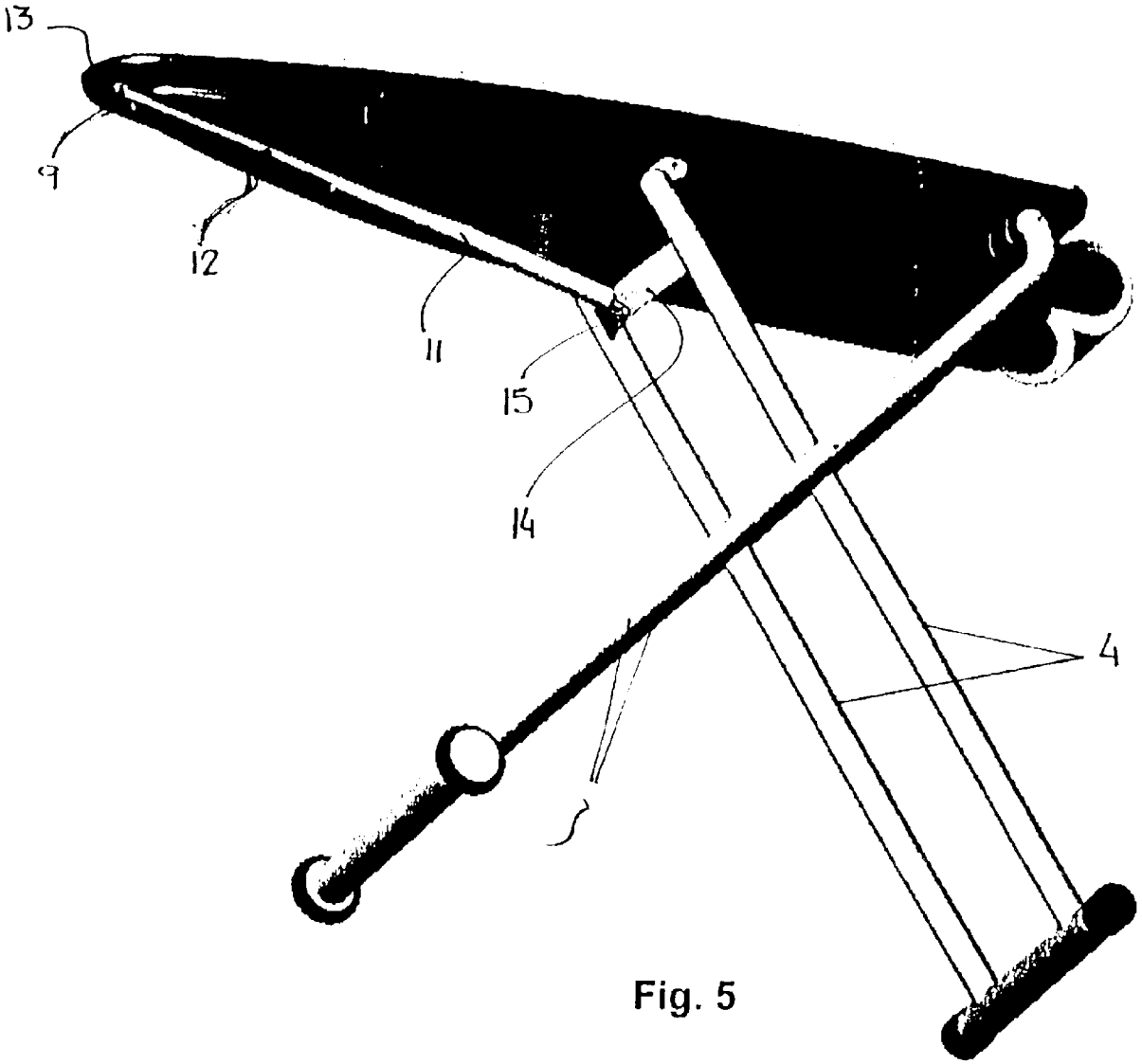
FIG. 5 shows a second embodiment of the invention.
Figure 6:
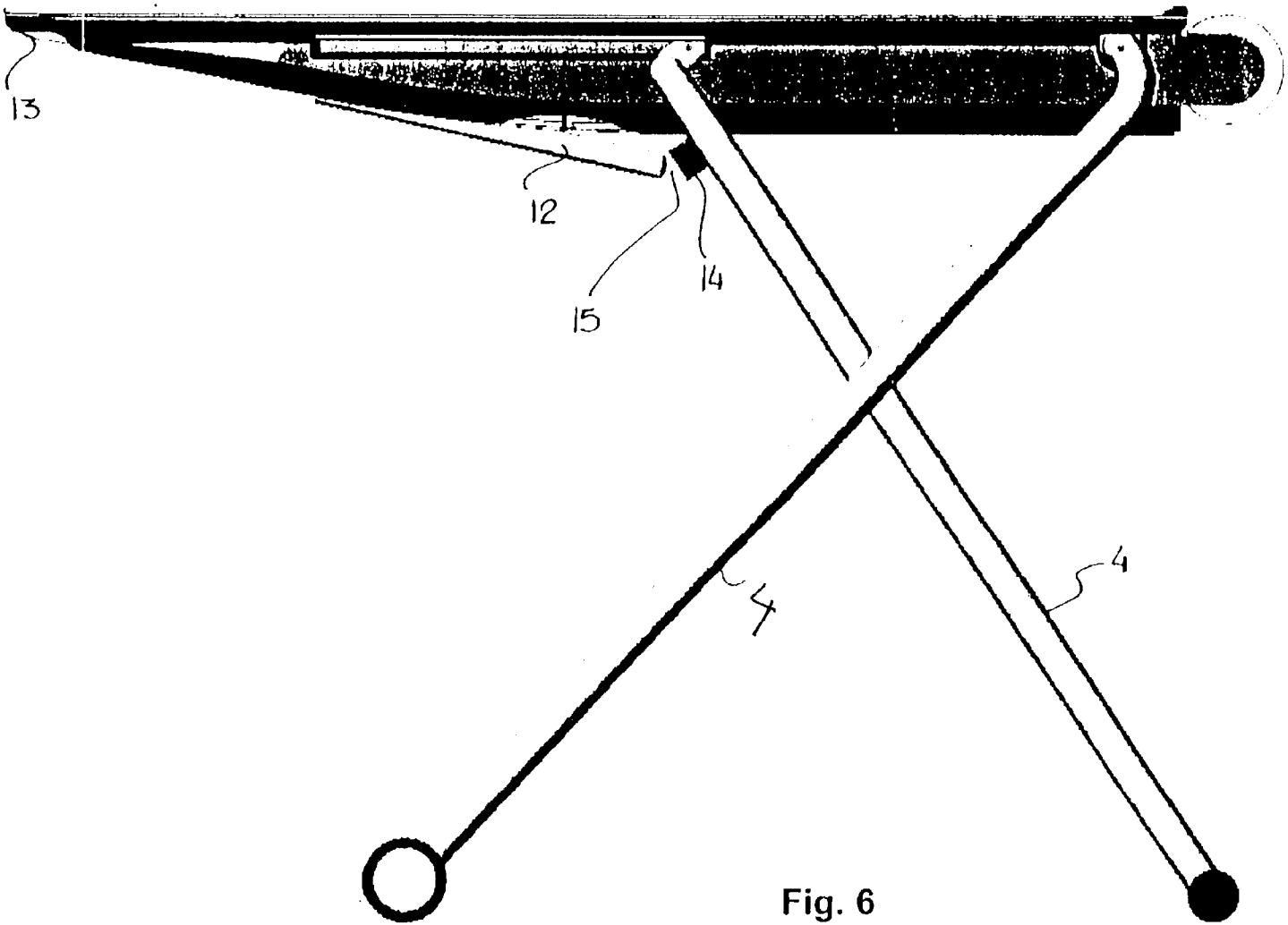
FIG. 6 shows the board shown in FIG. 5, seen from the side.
Figure 7:
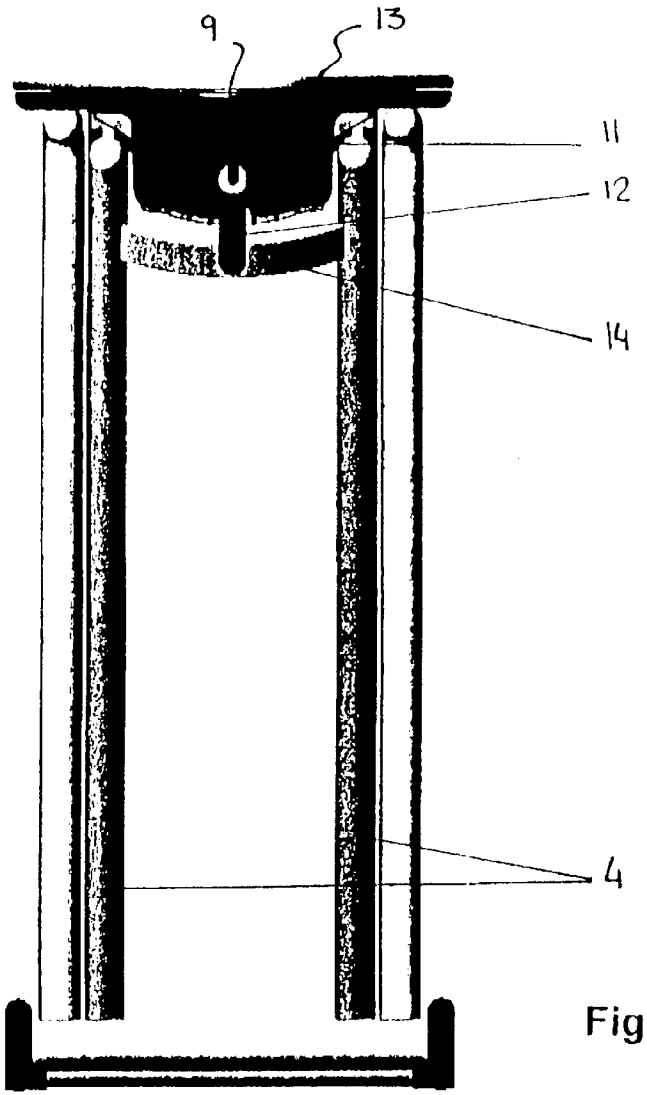
FIG. 7 shows the board shown in FIG. 5, seen from the front.

A jack (6), preferably pneumatic, is located underneath the table (2) (see also FIGS. 3 and 4). Its fixed part (11) is made fast to the common spindle (5) and pivots about it. The upper end (9) of its moveable part (12) is fixed to the table (2). A cable (not shown) is fixed toward the upper end (9) of the moveable part (12) of the jack. The end of the cable opposite from the jack is fixed to a rotary handle (10) situated next to the table (10), roughly in the continuation of one of the two legs (3).

The height is adjusted as follows: if the user wishes to raise the table (2), he turns the handle (10) in either direction (it does not matter which). This pulls the cable, actuates the jack and raises the table (2). If necessary, the user applies a slight upward force to the handle (10) while maintaining the traction on the cable. Once the desired height is reached, the user releases the handle (10).

If the user wishes to lower the table (2), he must carry out the same type of operation as described above. In this case, however, he must turn the handle (10) and apply a downward force on the board.

If the table is to be folded, all that is required is to apply the downward force while maintaining the traction on the cable, until the table reaches ground level.

The force to be applied by the user to raise or lower the table (2) is a function of the weight of the table. If this is great, the force required to raise the table will be relatively great, and the force to lower it relatively small, or even zero.

Conversely, if the table (2) is not very heavy, the force required to raise it will be relatively weak, or even zero, whereas the force to lower it will be relatively great.

In all cases, the jack (6) as described in the above example also acts as an aid for opening the board (1).

FIGS. 5 to 8 show a particularly advantageous embodiment of the invention.

The moveable upper end (9) of the jack is fixed to the support of the table at its end (13). The lower end (15) of the jack is fixed to a plate (14) situated in the upper part of the moveable leg (4).

It should be pointed out that it is preferable for the region where the lower end (15) of the jack is fixed not to be situated at the upper end of the moveable leg. A moment is thus produced when the board is being opened or closed, which reduces the energy deployed by the jack.

Actually, the choice of where to fix the lower end (15) of the jack is the result of a compromise between on the one hand the need to produce a moment and on the other to conceal the jack in the support of the board, this latter point being of a purely aesthetic nature.

Consequently the region where the lower end (15) of the jack is fixed may quite possibly be some distance away from the upper end of the moveable leg (4), and therefore quite close to the common axis (5) about which the legs pivot.

Figure 8:
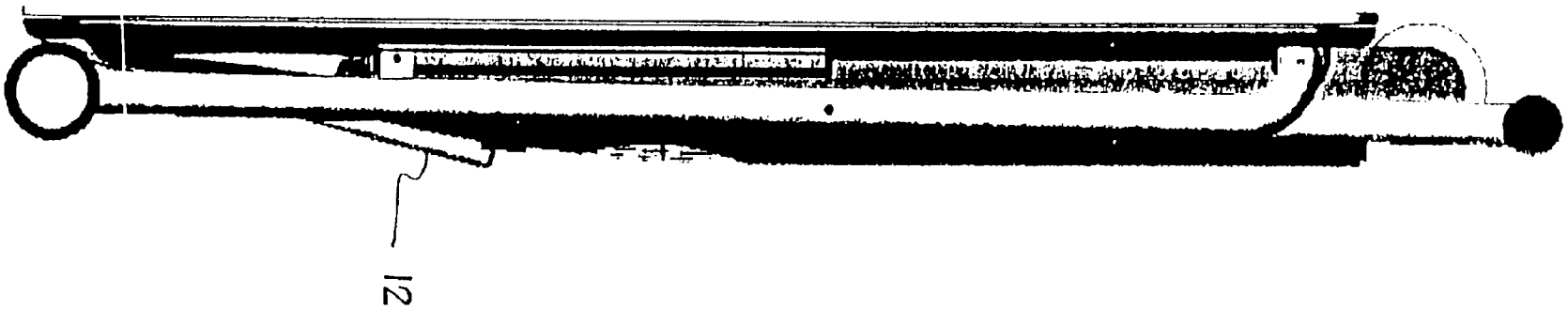
FIG. 8 shows the table shown in FIG. 5 when folded.

As is observable in FIG. 8, the arrangement of the jack allows the board to be folded flat.

Height adjustment is not of course limited to the use of a rotary handle. In the embodiment illustrated in FIGS. 5 to 8, it is preferable to use a lever working in a similar way to a motor cycle brake.

It goes without saying that the invention is not limited to the examples discussed above. In an embodiment that is not illustrated, the jack is an integral part of the leg whose upper end can move freely. In such a configuration, a lengthening of the jack results in a lowering of the table. Conversely, if the length of the jack is reduced, the table rises.

Many variants exist, of course, that are not described in the present text but come within the scope of the present invention. It will be noted, for example, that the number of jacks is not limited.

Lastly, it may be pointed out in a general way that the choice of the fixing points of the jack or jacks is not limited provided continuous adjustment of the height of the board can be ensured.

What is claimed is:

1. An ironing board comprising:

a table a support for supporting the table and a device for adjusting the height of the table, the support comprising at least two intersecting legs pivoting about a common axis, the upper ends of the legs being made fast to the table, and at least one of the legs being moveable, its upper end being able to be moved in a plane parallel to that of the table, which board is characterized in that the device for adjusting the height comprises continuous height-adjusting means consisting of a jack composed of a first part and a second part, the first part of the jack being made fast to the moveable leg in the region defined between the upper end of the moveable leg and the common axis, and wherein the upper end of the second part of the jack is fixed to the support of the table.

2. The ironing board according to claims 1, characterized in that the first part of the jack is fixed into the upper part of the moveable leg and in that the upper end of the second part of the jack is fixed toward one of the ends of the support of the table.

3. The ironing board according to claim 1, characterized in that the first part of the jack is made fast to and pivots about said common axis.

4. The ironing board according to claim 1, characterized in that the upper end of the second part of the jack is fixed to the fixed leg.

5. The ironing board according to claim 1, characterized in that the jack is part of the moveable leg.

6. The ironing board according to claim 1, characterized in that the height-adjusting means are controlled remotely.

7. The ironing board according to claim 6, characterized in that the height-adjusting means comprise a cable, of which the opposite end from the jack is accessible near the table, adjustment being effected by pulling the cable.

8. The ironing board according to claim 1, characterized in that it comprises a rotary handle situated toward the table, to which handle the end of a cable opposite from the jack is fixed, said handle being designed so that its rotation in one direction or the other pulls the cable to actuate the jack.

9. The ironing board according to claim 7, characterized in that it comprises a lever, to which the opposite end of the cable from the jack is fixed, said lever being designed so that when pivoted in one direction it pulls the cable to actuate the jack.

* * * * *